United States Patent [19]

Takahashi et al.

[11] 4,432,854

[45] Feb. 21, 1984

[54] WEB CONVEYING METHOD AND APPARATUS

[75] Inventors: Masahiro Takahashi; Toshio Hagiwara; Tsutomu Kakei; Kazutaka Oda, all of Shizuoka, Japan

[73] Assignee: Fuji Photo Film Co., Ltd., Minami-ashigara

[21] Appl. No.: 238,909

[22] Filed: Feb. 27, 1981

[30] Foreign Application Priority Data

Feb. 29, 1980 [JP] Japan ..... 55-24773

[51] Int. Cl.[3] ..... C25D 17/00

[52] U.S. Cl. ..... 204/206

[58] Field of Search ..... 204/206, 207, 208, 209, 204/210

[56] References Cited

U.S. PATENT DOCUMENTS 2,930,739 3/1960 Burnham ..... 204/28

3,537,971 11/1970 Green ..... 204/206 X 3,669,865 6/1972 Semienko et al. ..... 204/206

3,880,744 4/1975 Idstein ..... 204/206

*Primary Examiner*—T. M. Tufariello

*Assistant Examiner*—Nam X. Nguyen

*Attorney, Agent, or Firm*—Sughrue, Mion, Zinn, Macpeak & Seas

[57] ABSTRACT

A web conveying method and apparatus in which a metal web is maintained substantially parallel to an adjacent electrode despite fluctuations in the flow of an electrolytic solution in which the web is immersed. A guide plate is disposed adjacent the web on the side thereof opposite the electrode. A plurality of through-holes are formed in the guide plate which are evenly distributed thereon. Due to the flow of solution through the guide plate, a static pressure is applied to the web which maintains it substantially parallel at all times to the electrode.

26 Claims, 8 Drawing Figures

WEB CONVEYING METHOD AND APPARATUS

BACKGROUND OF THE INVENTION

The present invention relates to a method and apparatus for conveying a belt-shaped metal material, particularly a metal web, stably at a predetermined position in a liquid medium.

In the electrolytic treatment of the surface of a metal material of aluminum or iron, various treatments such as plating, electrolytic polishing, electrolytic etching, anodic oxidizing, electrolytic coloring and scraping treatments are extensively employed. In addition, a continuous electrolytic treatment method in which such an electrolytic treatment is continuously applied to a metal web is also known in the art.

FIG. 1 is a schematic sectional view showing the arrangement of an example of an apparatus which operates in accordance with a conventional continuous electrolytic treatment method. In FIG. 1, a metal web 1 supplied from a metal web roll is conveyed into an electrolytic bath 31 by rolls 21 and 22 and out of the electrolytic solution 30 in the electrolytic bath by rolls 23 and 24. An electrode 40 is arranged in the electrolytic bath 31 confronting the metal web running between the rolls 22 and 23. A voltage is applied between the electrode 40 and current supplying rolls 25 and 26 so that current flows between the metal web 1 and the electrode 40 through the electrolytic solution 30 to subject the metal web 1 to electrolytic treatment.

In order to provide a uniform electrolytic treatment on a metal web using such a continuous electrolytic treatment method, it is essential that the surface of the electrode which confronts the metal web be maintained parallel to the surface of the metal web which is subjected to the electrolytic treatment. In order to satisfy this requirement, a technique has been employed in which the electrode surface is made flat and the metal web is run with tension imposed on the metal web between the rolls 22 and 23 whereby the metal web surface is maintained parallel to the electrode surface.

As shown in FIG. 1, the electrolytic solution in a tank 34 is supplied into the electrolytic bath 31 through an electrolytic solution supplying inlet 32 by a pump P while the electrolytic solution 30 is returned to the tank 34 through an electrolytic solution discharging outlet 33. That is, the electrolytic solution is circulated by the pump P in such a manner as to maintain factors such as the composition, concentration and temperature of the electrolytic solution 30 unchanged. Due to the recirculation, the flow of the electrolytic solution through the electrolytic bath 31 tends to be irregular or turbulent. The turbulent flow affects the metal web running between the rolls 22 and 23 causing it to vibrate or shake. Thus, in practice, it is difficult to maintain the metal web parallel to the electrode surface. Furthermore, the above-described method is ineffective in maintaining the metal web parallel to the electrode surface in the widthwise direction of the metal web. Accordingly, the distance between the side portions of the metal web and the electrode surface is often different from the distance between the central portion of the metal web and the electrode surface. In general, the side portions of the metal web tend to drape downward compared to the central portion. Thus, frequently the side portions of the metal web have a different electrolytic treatment surface finish than the central portion.

Accordingly, an object of the invention is to provide an improved web conveying method and apparatus with which a metal web is run at predetermined positions, for instance, in a continuous electrolytic treatment bath.

A more specific object of the invention is to provide a method and apparatus for conveying a metal web through an electrolytic solution in an electrolytic treatment bath in such a manner that the metal web surface is maintained strictly parallel to an electrode surface.

Another object of the invention is to provide a method and apparatus for conveying a metal web through an electrolytic treatment bath in which the metal web is run without being affected by turbulent flow of the electrolytic solution in the region where the metal web confronts the electrode surface thereby to subject the metal web to uniform electrolytic treatment.

A further object of the invention is to provide a metal web conveying method and apparatus in which a metal web surface is maintained parallel to an electrode surface even in the widthwise direction of the metal web in an electrolytic treatment bath whereby the metal web is subjected to uniform electrolytic treatment even in the widthwise direction of the metal web.

A still further object of the invention is to provide a web conveying method and apparatus which is applicable to the conveyance of a variety of webs in which a predetermined part of the web in a liquid medium is maintained planar with a high precision.

SUMMARY OF THE INVENTION

The inventors have conducted intensive research to achieve the above-described various objects of the invention and as a result have conceived the present invention. In accordance with the invention, a web conveying method and apparatus is provided in which, according to the invention, a guide plate is arranged which has a sliding surface on which a running web slides and through-holes which open in the sliding surface. The web is run while being abutted against the sliding surface by the static pressure of a liquid medium which acts in the direction of the through-holes from the side of the sliding surface.

DESCRIPTION OF THE PREFERRED EMBODIMENTS

The invention will be described with reference to FIGS. 2 through 6 in detail.

Figure 1:
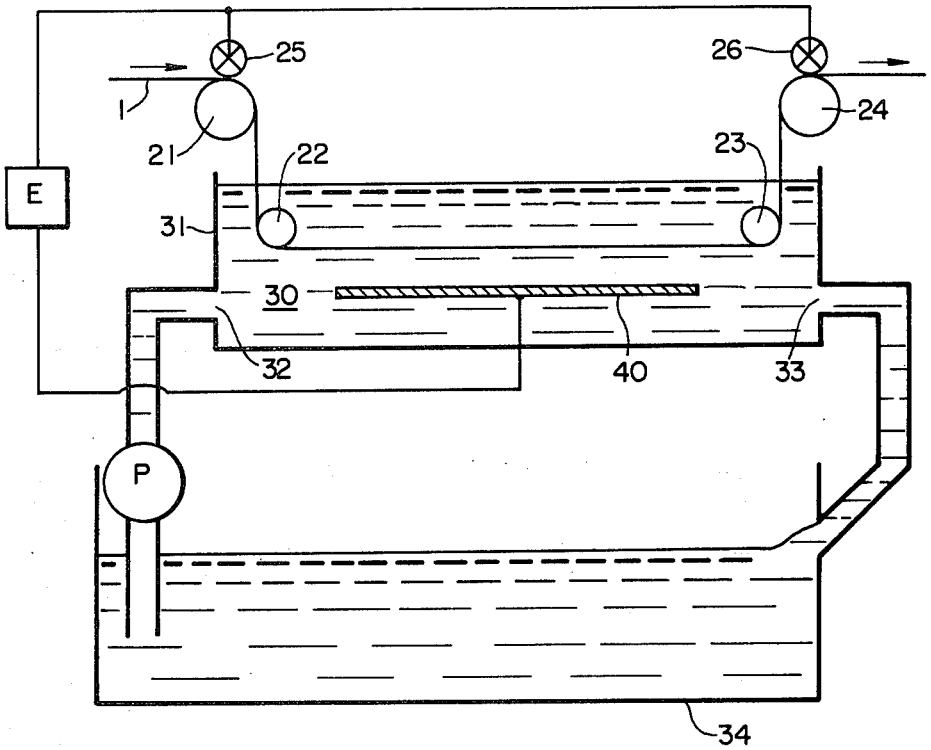
FIG. 1 is a schematic diagram showing the arrangement of a conventional continuous electrolytic treatment apparatus.
Figure 2:
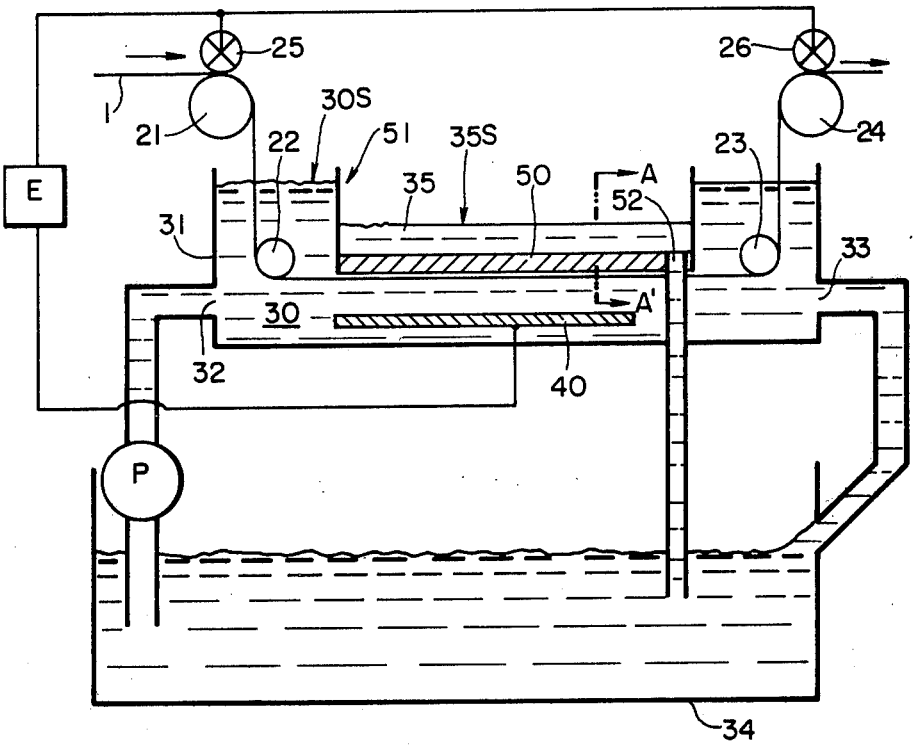
FIGS. 2, 7 and 8 are schematic sectional views showing preferred embodiments of a continuous electrolytic treatment apparatus utilizing a web conveying method according to the invention.

FIG. 2 is a schematic diagram showing the arrangement of a preferred embodiment of an apparatus for practicing a metal web continuous electrolytic treatment method employing a web conveying method according to the invention. A metal web 1 is conveyed into an electrolytic bath 31 filled with an electrolytic solution 30 by rolls 21 and 22 and is then conveyed out of the electrolytic bath 31 by rolls 23 and 24. In this operation, the web 1 is maintained substantially horizontal between the rolls 22 and 23. In this substantially horizontal region, a guide plate 50 having vertically extending through-holes is disposed in such a manner that the bottoms of the through-holes are substantially covered by the metal web 1. The guide plate 50 is surrounded by walls 51, for instance, so that the electrolytic solution 30 is not permitted to flow sidewardly to the upper surface of the guide plate. That is, the electrolytic solution 30 is allowed to flow to the upper surface of the guide plate 50 only through the through-holes. In this connection, the walls 51 provided parallel to the direction of movement of the metal web 1 may be replaced by the walls of the electrolytic bath 31.

With the guide plate 50 arranged as described above, the metal web confronting the guide plate 50 is pushed up to the bottom of the guide plate 50 by the static pressure of the electrolytic solution 30, and accordingly the metal web is conveyed while sliding on the bottom of the guide plate 50. It should be noted that, in this operation, the through-holes of the guide plate 50 are not completely closed by the metal web. Accordingly, the electrolytic solution 30 is allowed to flow to the upper surface of the guide plate 50 and is stored in the region defined by the guide plate 50 and the walls 51 as indicated by reference numeral 35. A discharge outlet 52 is provided to permit the electrolytic solution 35 to flow down to the tank 34 so that the difference between the level 30S of the electrolytic solution 30 and that 35S of the electrolytic solution 35 is maintained at a predetermined level. Thus, the metal web is conveyed while being pushed against the bottom of the guide plate 50 under a constant static pressure. Accordingly, with the bottom of the guide plate 50 made flat, the metal web is maintained flat.

An electrode 40 is fixedly secured in such a manner that the surface of the electrode 40 which confronts the bottom of the guide plate 50 is parallel to the bottom of the guide plate 50. Therefore, the metal web surface is maintained parallel to the electrode surface. When a voltage is applied between the electrode 40 and current feeding rolls 25 and 26 by an electric source E, current flows between the metal web 1 and the electrode 40 through the electrolytic solution 30 as a result of which the metal web 1 is subjected to uniform electrolytic treatment. Although the electrolytic solution 30 is discharged into a tank 34 through an electrolytic solution discharging outlet 33 and the electrolytic solution thus discharged is fed back to the electrolytic bath 31 through an electrolytic solution introducing inlet 32 by a pump P to be recirculated, the metal web 1 is maintained abutted against the guide plate 50. Therefore, even if the flow of the electrolytic solution 30 is turbulant, the metal web will not shake. As the metal web is maintained abutted against the guide plate, the metal web is maintained parallel to the electrode surface also in the widthwise direction thereof. Accordingly, a uniform electrolytic treatment is applied to the metal web also in the widthwise direction.

Because the metal web is conveyed while sliding along the bottom of the guide plate as described above, if the bottom of the guide plate were simply a flat surface, then the sliding resistance is relatively high and therefore sometimes it is difficult to smoothly convey the metal web. Accordingly, it is desirable that the bottom of the guide plate be so formed that the contact area with the metal web is as small as possible.

Figure 3:
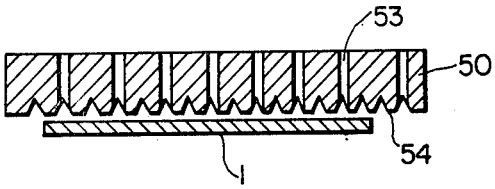
FIGS. 3 and 4 are sectional views taken along line A—A' in FIG. 2 showing examples of a guide plate and a metal web.
Figure 4:
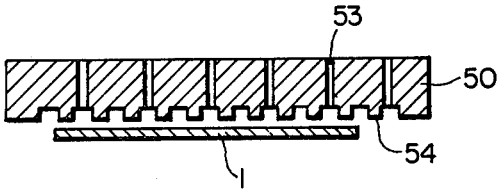

FIGS. 3 and 4 are sectional views taken along line A—A' in FIG. 2 showing embodiments of a guide plate which has a bottom which satisfies the above-described requirement. In the embodiment shown in FIG. 3, V-shaped grooves are cut in the bottom of the guide plate 50 extending parallel to the direction of movement of the metal web. In this embodiment, the bottom of the guide plate is brought into contact with the metal web only at the tops 54 of the trapezoids between the grooves. The sliding resistance is accordingly reduced to allow the metal web to move smoothly. Through-holes 53 are formed in the guide plate opening into the V-shaped grooves. It is preferable that the region of the bottom of the guide plate where the through-holes 53 are formed be covered by the metal web 1. However, the width of the region can be made larger than the width of the metal web if the configuration and the distribution density of the through-holes are suitably selected. In the embodiment shown in FIG. 4, the bottom of the guide plate has a different configuration from that in the embodiment shown in FIG. 3. More specifically, instead of the V-shaped grooves in FIG. 3, rectangular grooves are cut in the bottom of the guide plate. When a guide plate having a bottom shaped as shown in FIG. 3 or 4 is used for an aluminum web 0.1 to 0.5 mm in thickness for instance, the width of each contact portion of the bottom should be about 0.5 to 10 mm, more preferably 1 to 4 mm, and the width of each groove about 0.5 to 30 mm, more preferably 3 to 16 mm. However, it should be noted that the actual values selected depend on the thickness and material of the metal web employed.

As described above, the provision of the through-holes causes a static presence in the electrolytic solution beneath the guide plate so as to push the metal web against the guide plate. For this purpose, the through-holes may be shaped as desired so long as they can be covered by the metal web.

Figure 5:
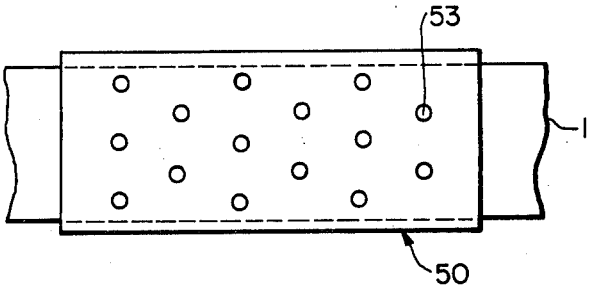
FIGS. 5 and 6 are plan views showing embodiments of a guide plate used with the invention.
Figure 6:
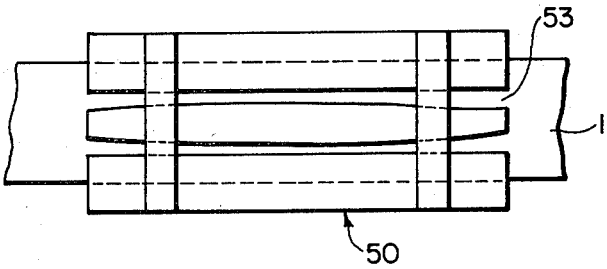

FIGS. 5 and 6 are plan views of embodiments of the guide plate 50, as viewed from above, having different configurations of through-holes. In FIG. 5, circular through-holes 53 are regularly arranged in the guide plate 50. In FIG. 6, slit-shaped through-holes 53 are formed. With the slit-shaped through-holes 53 provided in the region of the guide plate the width of which is smaller than the width of the metal web 1, the slit-shaped through-holes 53 can be covered by the metal web 1. In the embodiments shown in FIGS. 3 and 4, the size of the top of each through-hole is the same as the size of the bottom. However, it is not always necessary to do so. For instance, the size of the top may be larger than the size of the bottom so that the through-holes are conical. Alternately, the through-hole may be so shaped that it has a shoulder or a stepped portion. Furthermore, a porous material having an excellent liquid permeability may be used as the guide plate.

In accordance with the invention, a guide plate having through-holes arranged regularly as shown in FIG. 5 is most desirable. In the electrolytic treatment of a metal web of small width, such a guide plate is effective because the flow rate of the electrolytic solution is limited by decreasing the diameter of the through-holes as a result of which a desired static pressure is produced although the through-holes in both side portions of the guide plate are not closed by the metal web. On the other hand, with a guide plate such as that shown in FIG. 6, the guide plate itself must be replaced by a different one to be used with different size webs.

In the case of using a guide plate having through-holes as shown in FIG. 5 for an aluminum web having a thickness of 0.1 to 0.5 mm for instance, the diameter of the through-holes should be about 0.2 to 10 mm, more preferably 1 to 3 mm, and the through-hole distribution density about 20 to about 1000/m$^2$, more preferably 50 to 300/m$^2$. However, it should be noted that the exact values employed depend on various conditions such as metal web thickness and the material of the web.

The metal web is moved while sliding on the bottom of the guide plate as described above. Accordingly, at least the bottom of the guide plate is made of a plastic material having a low frictional resistance such as chlorinated polyether, vinyl chloride resin, vinylidene chloride resin, polyethylene, polypropylene, polystyrene or "Teflon" TM (polytetrafluoroethylene).

As was described above, it is essential that the apparatus be so designed that the electrolytic solution from the electrolytic bath not be permitted to flow sidewardly to the upper surface of the guide plate, that is, so that the solution can flow to the upper surface only through the through-holes. For this purpose, the guide plate 50 is surrounded by the walls 51 as shown in FIG. 2. The electrolytic solution brought to the upper surface of the guide plate through the through-holes must be discharged. The electrolytic solution can be discharged by a technique whereby the discharge outlet 52 is formed as shown in FIG. 2 to allow the electrolytic solution to flow down therethrough by the force of gravity into the tank 34. If this technique is employed, it is preferable that the guide plate be inclined to lower the discharge outlet or the guide plate is so molded that the bottom surface is maintained horizontal but the top surface is inclined towards the discharge outlet to thus allow the electrolytic solution to flow down the guide plate smoothly. In accordance with another technique, the electrolytic solution on the guide plate is discharged with a pump.

In general, when the electrolytic solution 30 is circulated as described above, the level of the electrolytic solution in the electrolytic bath is higher on the side of the inlet 32 than that on the side of the outlet 33. It is possible to make the level of the electrolytic solution 30 on the side of the outlet 33 lower than the level of the electrolytic solution 35 on the guide plate. In spite of this fact, it is possible to force the electrolytic solution to flow only through the through-holes to the upper surface of the guide plate. The one of the walls 51 which confronts the outlet 33 can be eliminated so that the electrolytic solution 35 above the guide plate 50 flows to the outlet 33 by force of gravity. In this case, the level of the electrolytic solution in the electrolytic bath on the side of the outlet 33 is lower than that of the electrolytic solution 35 on the guide plate. However, the metal web is maintained abutted against the bottom surface of the guide plate 50 by the static pressure. It goes without saying that, in this case, the discharge outlet 52 as shown in FIG. 2 can be eliminated from the guide plate 50. Furthermore, in this case, it is advantageous to incline the electrolytic bath and the guide plate towards the outlet because the circulation of the electrolytic solution 30 in the electrolytic bath and the flow of the electrolytic solution 35 on the guide plate are effected more smoothly.

Figure 7:
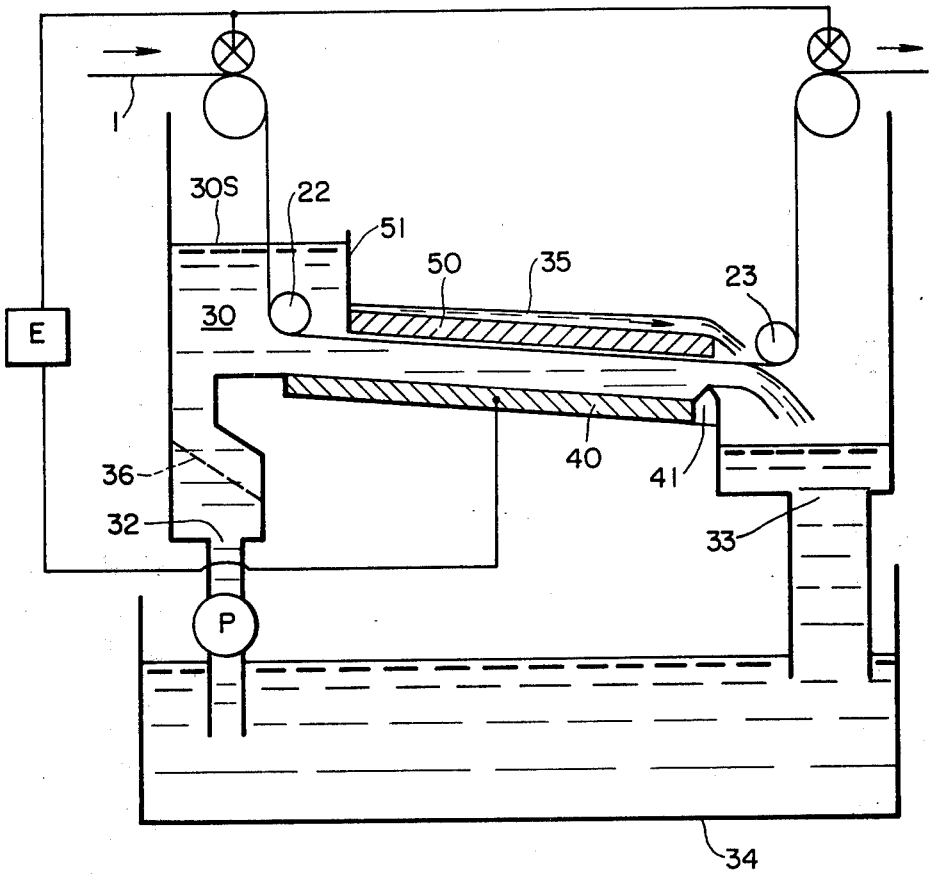

FIG. 7 is a schematic sectional view showing an embodiment of an apparatus for practicing the continuous electolytic treatment method according to the invention.

In this apparatus, the bottom surface of an electrolytic bath 31 and a guide plate 50 are inclined. The electrolytic solution in a tank 34 is delivered through the inlet 32 of the electrolytic bath 31 to a baffle board 36 which regulates the flow of the solution. The electrolytic solution thus regulated is further delivered between a metal web and an electrode 40 and is then returned to the tank 34 through an outlet 33. The guide plate 50, which has through-holes formed therein, is disposed above the metal web which is moving over rolls 22 and 23. The guide plate 50 has walls 51 at its three sides and it is open at the side confronting the outlet 33 so that the electrolytic solution in the electrolytic bath is not permitted to flow sidewardly to the upper surface of the guide plate 50. The level of the electrolytic solution in the electrolytic bath, indicated by reference character 30S, is higher on the side of the inlet 32 than on the side of the outlet with the result that a uniform flow of the electrolytic solution 30 is formed between the metal web surface and the electrode surface by the difference between the two static pressures. That is, the static pressure required for causing the electrolytic solution to flow along the desired flow path at a desired speed is applied to the side of the inlet so that the space between the metal web surface and the electrode surface is filled with the electrolytic solution flowing uniformly. On the other hand, the electrolytic solution 35 which flows to the upper surface of the guide plate through the through-holes is allowed to flow down the guide plate in the direction of the arrow to the outlet under the force of gravity. The pressure pressing the metal guide against the guide plate is lower on the side of the outlet. Therefore, it is desirable to provide a dam 41 at the lower edge of the electrode plate 40. In this case, the metal web can be conveyed more stably.

A suitable range of static pressure for pushing the metal web against the guide plate depends on the configuration and material on the guide plate and the kind of metal web employed. If the static pressure is excessively low, the conveyance of the metal web will be adversely affected by turbulant flow of the electrolytic solution. On the other hand, if the static pressure is excessively high, sliding friction between the metal web and the guide pressure is increased so that is is difficult to smoothly convey the metal web and, at worst, the surface of the metal web which confronts the guide plate will be damaged. Thus, for an aluminum web having a thickness of 0.1 to 0.5 mm, the range of static pressure is from 1 to 10 cm of a water column.

Figure 8:
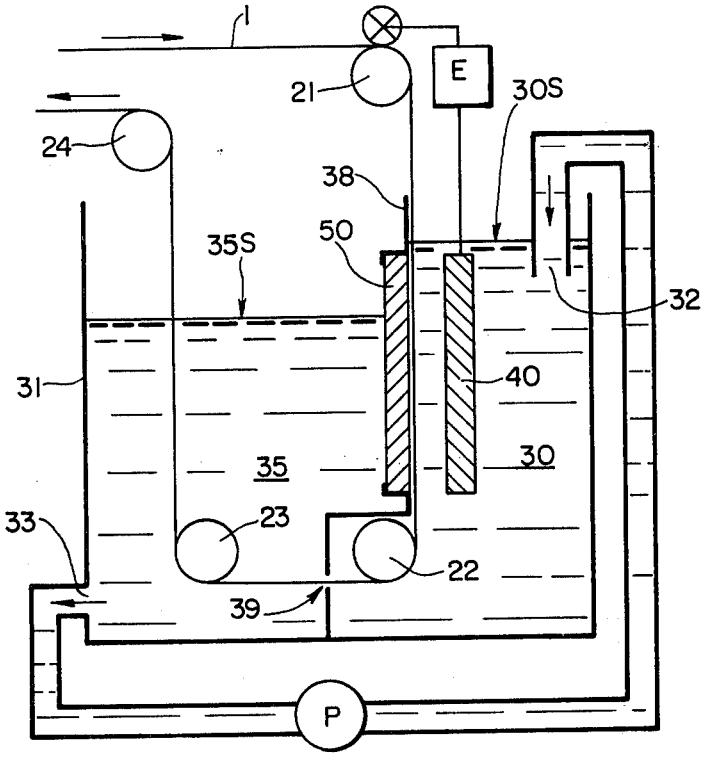

In the above-described apparatuses, the web conveying method of the invention is applied to a metal web which runs substantially horizontally. However, it should be noted that the web conveying method of the invention can be applied to a metal web which runs in a direction other than a horizontal direction. FIG. 8 shows an embodiment of an apparatus which is applied to a metal web running vertically. As shown in FIG. 8, an electrolytic bath is divided into two baths by a partition 38. A guide plate 50 having through-holes forms a part of the partition. A metal web 1 is laid over rolls 21 and 22 and is then introduced into the first bath filled with an electrolytic solution 30 while running along the guide board 50. Then, the metal web is conveyed into the second bath filled with the electrolytic solution 35 after passing through a slit 39 formed in the partition 38.

The metal web is then conveyed out of the electrolytic bath 31 by rolls 23 and 24. The level 30S of the electrolytic solution 30 in the first bath is higher than that 35S of the electrolytic solution 35 in the second bath. Moreover, the guide plate 50 has through-holes formed therein so that the metal web 1, while being pressed against the guide plate by the liquid pressure, is conveyed while sliding on the surface of the guide plate on the side of the first bath. Accordingly, if the surface of the guide plate is parallel to the guide-plate-side surface of the electrode 40, then similarly to the above-described apparatus, the surface of the metal web is subjected to uniform electrolytic treatment. The electrolytic solution 30 in the first bath can be made to flow into the second bath through the slit 39 or through the through-holes of the guide plate 50. The electrolytic solution 30 which has flowed into the second bath is returned to the first bath by a pump P so that the difference between the level 30S of the electrolytic solution 30 and the level 35S of the electrolytic solution 35 is maintained unchanged and the metal web is maintained abutted against the guide plate by the constant liquid pressure.

While the web conveying method of the invention has been described with reference to a case where a metal web is subjected to a continuous electrolytic treatment, it can be readily understood from the above description that the web conveying method of the invention can be employed not only for a continuous electrolytic treatment but also to a general web conveying method.

What is claimed is:

1. A web conveying apparatus comprising:

an electrolytic bath;

an electrode;

means for conveying a web through said electrolytic bath so that a first face of said web travels adjacent said electrode;

means for supporting an opposite face of said web as said web is conveyed through said electrolytic bath, said supporting means comprising a guide plate having a plurality of through-holes formed therein; and means for applying a static pressure to said web in said electrolytic bath to press said web against a first side of said guide plate to keep said first face of said web adjacent said electrode, said static pressure applying means comprising means for maintaining a static electrolytic solution fluid pressure of said bath adjacent said first side of said supporting means higher than a static electrolytic solution fluid pressure of said bath adjacent a second side of said supporting means which is opposite said first side so that electrolytic solution flows from said first side to said second side through said through-holes.

2. The web conveying apparatus of claim 1 wherein said supporting means comprises a porous plate.

3. The web conveying apparatus of claim 1 wherein said supporting guide plate is adjacent said electrode.

4. The web conveying apparatus of claim 3 wherein said through-holes are circular and are regularly arranged on said guide plate.

5. The web conveying apparatus of claim 4 wherein said through-holes are conically shaped.

6. The web conveying apparatus of claim 3 wherein said through-holes are formed with a shoulder portion therein.

7. The web conveying apparatus of claim 2 wherein said through-holes have V-shaped grooves at the side of said guide plate adjacent said web.

8. The web conveying apparatus of claim 3 wherein said through-holes have rectangular grooves formed therein on the side of said guide plate adjacent said opposite web face.

9. The web conveying apparatus of claim 3 wherein said through-holes are slit shaped and are provided in a region of said guide plate the width of which is smaller than the width of said web.

10. The web conveying apparatus of claim 3 further comprising means for applying an electric current between said electrode and said web.

11. The web conveying apparatus of claim 3 further comprising a plurality of walls extending upwardly from all edges of said guide plate except for a downstream edge of said guide plate on a side of said guide plate opposite said web.

12. The web conveying apparatus of claim 3 further comprising a plurality of walls surrounding said guide plate on the side thereof opposite said web.

13. The web conveying apparatus of claim 12 further comprising discharge outlet means disposed at a downstream end of said guide plate.

14. The web conveying apparatus of any one of claims 3–13 wherein the side of said guide plate adjacent said opposite web face is formed of a low friction material.

15. The web conveying apparatus of any one of claims 2–13 wherein the side of said guide plate adjacent said opposite web face is formed of a low friction material, said low friction material comprising a material selected from the group consisting of chlorinated polyether, vinyl chloride resin, vinylidene chloride resin, polyethylene, polypropylene, polystyrene and polytetrafluoroethylene.

16. The web conveying apparatus of claim 3 wherein a bottom of said electrolytic bath comprises said electrode, said electrode and said guide plate being disposed parallel to one another and tilted relative to a horizontal plane to allow electrolytic fluid to flow thereon downward by the force of gravity.

17. The web conveying apparatus of claim 16 further comprising a dam at a lower end of said electrode.

18. The web conveying apparatus of claim 16 or 17 further comprising means for recirculating an electrolytic solution comprising a tank for receiving electrolytic solution discharged from a lower end of said electrode; pump means for pumping electrolytic solution from said tank towards an upper end of said electrode; and baffle board means disposed in an outlet of said pump for controlling the flow of said electrolytic solution to said upper end of said electrode.

19. The web conveying apparatus of claim 3 wherein said guide plate is disposed in a substantially vertical plane.

20. The web conveying apparatus of claim 19 further comprising a partition dividing said electrolytic bath into two sections, said guide plate being coupled as a art of said partition; and pump means for recirculating electrolytic solution from one of said sections to the other of said sections of said electrolytic bath.

21. The web conveying apparatus of claim 1 wherein said static pressure applying means and said supporting means comprises:

a guide plate which confronts said opposite web face, said guide plate having a plurality of walls extending upwardly on a side thereof opposite said web for preventing an electrolytic solution from forming around edges of said guide plate onto an upper surface of said guide plate side which is opposite said web, said guide plate having a plurality of holes therethrough; and a pump for pumping said electrolytic solution from said upper surface of said guide plate side which is opposite said web to said electrolytic bath so that an upper electrolytic solution surface in said bath is maintained at a higher elevation than is an upper electrolytic solution surface on said upper surface of said guide plate side which is opposite said web.

22. The web conveying apparatus of claim 21 wherein said plurality of walls surrounds said guide plate side opposite said web.

23. The web conveying apparatus of claim 21 wherein said plurality of walls extends upwardly from said guide plate side opposite said web and all edges thereof except a downstream side, said guide plate being tilted from a horizontal plane.

24. A web conveying apparatus comprising:

an electrolytic bath;

means for conveying a web through said electrolytic bath;

means for applying a static pressure to said web as it is transported through said electrolytic bath for maintaining said web substantially planar in a predetermined portion of said electrolytic bath said meas including a guide plate;

a bottom of said electrolytic bath comprising an electrode, said electrode and said guide plate being disposed parallel to one another and tilted relative to a horizontal plane to allow electrolytic fluid to flow thereon downward by the force of gravity.

25. The web conveying apparatus of claim 24 further comprising a dam at a lower end of said electrode.

26. The web conveying apparatus of claim 24 further comprising:

means for recirculating an electrolytic solution, said recirculating means including:

a tank for receiving electrolytic solution discharged from a lower end of said electrode;

pump means for pumping electrolytic solution from said tank towards an upper end of said electrode; and baffle board means disposed in an outlet of said pump for controlling the flow of said electrolytic solution to said upper end of said electrode.

* * * * *

UNITED STATES PATENT AND TRADEMARK OFFICE

CERTIFICATE OF CORRECTION

PATENT NO. : 4,432,854

DATED : February 21, 1984

INVENTOR(S) : MASAHIRO TAKAHASHI ET AL

It is certified that error appears in the above-identified patent and that said Letters Patent is hereby corrected as shown below:

At the title page, "(73) Assignee: Fuji Photo Film Co., Ltd., Minami-ashigara" should read --Assignees: Fuji Photo Film Co., Ltd., Kanagawa, Japan and Nippon Light Metal Co., Ltd., Tokyo, Japan--

Signed and Sealed this

*Twenty-first* Day of *May 1985*

[SEAL]

*Attest:*

DONALD J. QUIGG

*Attesting Officer*

*Acting Commissioner of Patents and Trademarks*